United States Patent [19]
Dato
[11] 4,199,146
[45] Apr. 22, 1980

[54] METHOD OF PLAYING A PSYCHOTHERAPEUTIC GAME

[76] Inventor: Robert A. Dato, 931 Marlyn Rd., Philadelphia, Pa. 19151

[21] Appl. No.: 850,563

[22] Filed: Nov. 11, 1977

[51] Int. Cl.[2] ..... A63F 3/00
[52] U.S. Cl. ..... 273/249; 273/292
[58] Field of Search ..... 273/292, 293, 299, 300, 273/302–304, 243, 248, 249, 272; 35/35 D, 35 J, 70, 71

[56] References Cited

U.S. PATENT DOCUMENTS 977,117 11/1910 McPherson ..... 273/304
1,569,945 5/1925 Brittingham ..... 273/292

FOREIGN PATENT DOCUMENTS 21018 4/1913 United Kingdom ..... 273/249

OTHER PUBLICATIONS

*1000 Family Games;* 1971; p. 162; "Card Games"; Reader's Digest.

*Primary Examiner*—Richard C. Pinkham
*Assistant Examiner*—R. Carl Moy
*Attorney, Agent, or Firm*—Caesar, Rivise, Bernstein & Cohen, Ltd.

[57] ABSTRACT

A game for two to six players to provide an indication of a player's present level of maturational functioning by his ability to make his communications understood and his ability to understand others' communications. The game comprises a pack of cards having sixsets. Each set includes six identical cards. Each card of a set bears a respective intentional type word and an associated score value. The intentional words are EXCLAMATION, DEMAND, COMPLAINT, REQUEST, CONCERN and SUGGESTION and the corresponding score values are 1, 2, 3, 4, 5 and 6, respectively. The game includes a mover for each player and a game board having a plurality of positions to be traversed in sequential steps from a start position to a finish position, with the number of steps taken being a function of the score values accumulated during each hand of play.

The game is played by each player being dealt six cards from the pack and thereafter one player striving to communicate the intentional word represented on the top card from his hand by making a verbal or non-verbal expression matching the intentional word on the card. The remaining players strive to identify the expression communicated by drawing from their respective hands a card bearing the intentional word each believes to match the expression communicated by the one player. The current player receives a score value equal to the sum of the score values on the cards drawn by the other players and which match the card chosen by the current player. Each other player accumulates a score value of the current player's chosen card if there is a match.

4 Claims, 2 Drawing Figures

METHOD OF PLAYING A PSYCHOTHERAPEUTIC GAME

This invention relates generally to games and more particularly to card games.

All communications between persons can be perceived according to two components, content and intent, with content being defined as what is said and intent being defined as how what is said is said. The concepts connoted by the words EXCLAMATION, DEMAND, COMPLAINT, REQUEST, CONCERN and SUGGESTION, or synonyms thereof, represent the totality of different manifestations of the intent variable of any communication. Accordingly, each of these words, or synonyms thereof, are hereinafter referred to as "intentions" or "intentional words".

The six intentional words break down into categories of expressive words and cooperative words, based upon their communicative purpose. Of the expressive type intentions are EXCLAMATION, COMPLAINT and CONCERN, of the cooperative type intentions are DEMAND, REQUEST and SUGGESTION. Each expressive and cooperative word presupposes that a different degree of stress has been perceived by the communicator. To that end, of the expressive intentions the intention EXCLAMATION is associated with the greatest stress perceived, and the intention CONCERN is associated with the least stress perceived. Similarly, with the cooperative intentions the intention DEMAND is associated with the greatest stress perceived, and the intention SUGGESTION is associated with the least stress perceived.

It has been postulated that an increase in the maturational functioning level of an individual is represented by a transition from expressive communications to cooperative communications and a concomitant transition from high perceived stress to low perceived stress. Accordingly, it is postulated that during the maturational process intentions are normally learned in the sequence of EXCLAMATIONS, DEMANDS, COMPLAINTS, REQUESTS, CONCERNS and SUGGESTIONS.

The game of the invention is based upon the above concepts and postulations and in so being makes it possible for the players to gain valuable insight into their present levels of maturational functioning while providing an entertaining and challenging diversion.

It is accordingly an object of the present invention to provide a novel game.

It is a further object of the invention to provide a novel game whose use provides the opportunity for gaining insight into the present maturational functioning levels of its players.

It is still a further object of the invention to provide a game method, whose use provides the opportunity for gaining insight into the present maturational functioning levels of its players and which is easy to learn and fun to play.

These and other objects of the invention are achieved by providing a game for two or more players comprising a pack of cards including six sets of cards. Each set includes plural identical cards. All of the cards of each set are identified by a respective intentional type word and an associated score value indicia appearing on the face side of the card. The intentional type words are EXCLAMATION, DEMAND, COMPLAINT, REQUEST, CONCERN and SUGGESTION. All of the cards of the pack have the same indicia, MATURITY, on the rear side thereof. The object of the game is to accumulate more score value than opposing players by effectively communicating the intentional word appearing on the top card in one's hand by making any verbal or non-verbal expression corresponding thereto and having the expression recognized by the opposing players or by understanding the communicated intentions of other players.

Other objects and many of the attendant advantages of the invention will be readily appreciated as the same becomes better understood by reference to the following detailed description when considered in connection with the accompanying drawing wherein.

Figure 1:
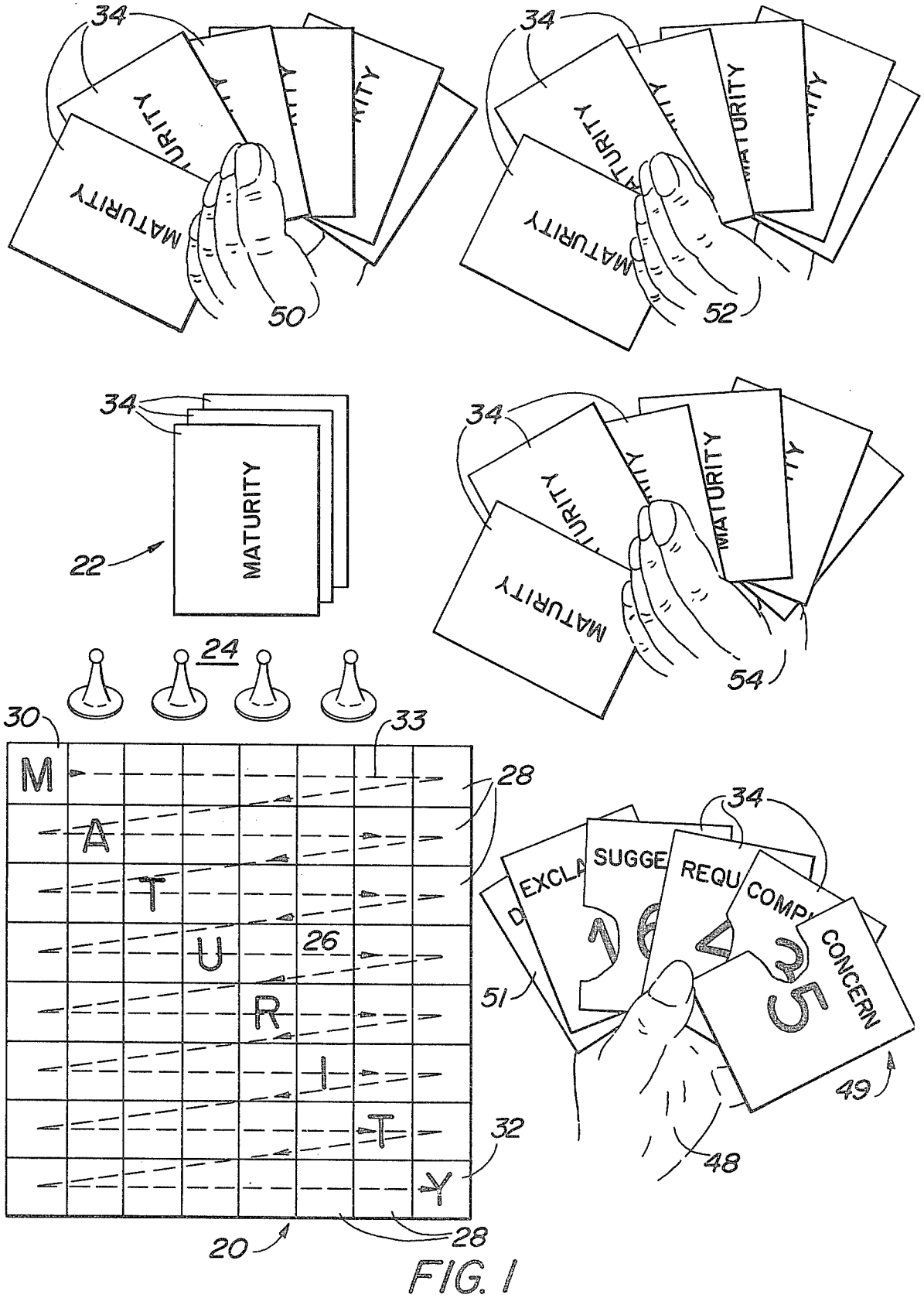
FIG. 1 is a perspective view of the game of the invention.

Referring now to the various figures of the drawing wherein like reference characters refer to like parts, there is shown generally at 20 in FIG. 1 a game in accordance with the invention. The game basically comprises a deck or pack of thirty-six playing cards 22, six moveable markers (movers) colored red, orange, yellow, green, blue and violet, 24, and a game board 26 bearing the word MATURITY across the spaces from upper left to lower right hand corner.

The game 20 of the invention is arranged to be played by any number from two to six players, with the ages of the players from eight through adulthood. By way of example, four players are shown playing the game 20 in FIG. 1.

As can be seen in FIG. 1, the game board is broken by a grid network into sixty-four boxes or spaces 28 and includes a start space 30 in the upper left hand corner of the board and a finish space 32 in the lower right hand corner. The spaces of the board are arranged to be traversed sequentially by each of the players' movers 24, starting from the start space 30 and finishing at the finish space 32. The sequential path to be taken along the board is shown by the dotted line 33 and as can be seen, is analogous to the path traversed in reading a page of print.

The deck of cards 22 includes thirty-six playing cards 34. On the rear side of each card there appears the same indicia. In the embodiment illustrated in FIG. 1 the indicia is the word MATURITY, that being the name of the game 20.

Figure 2:
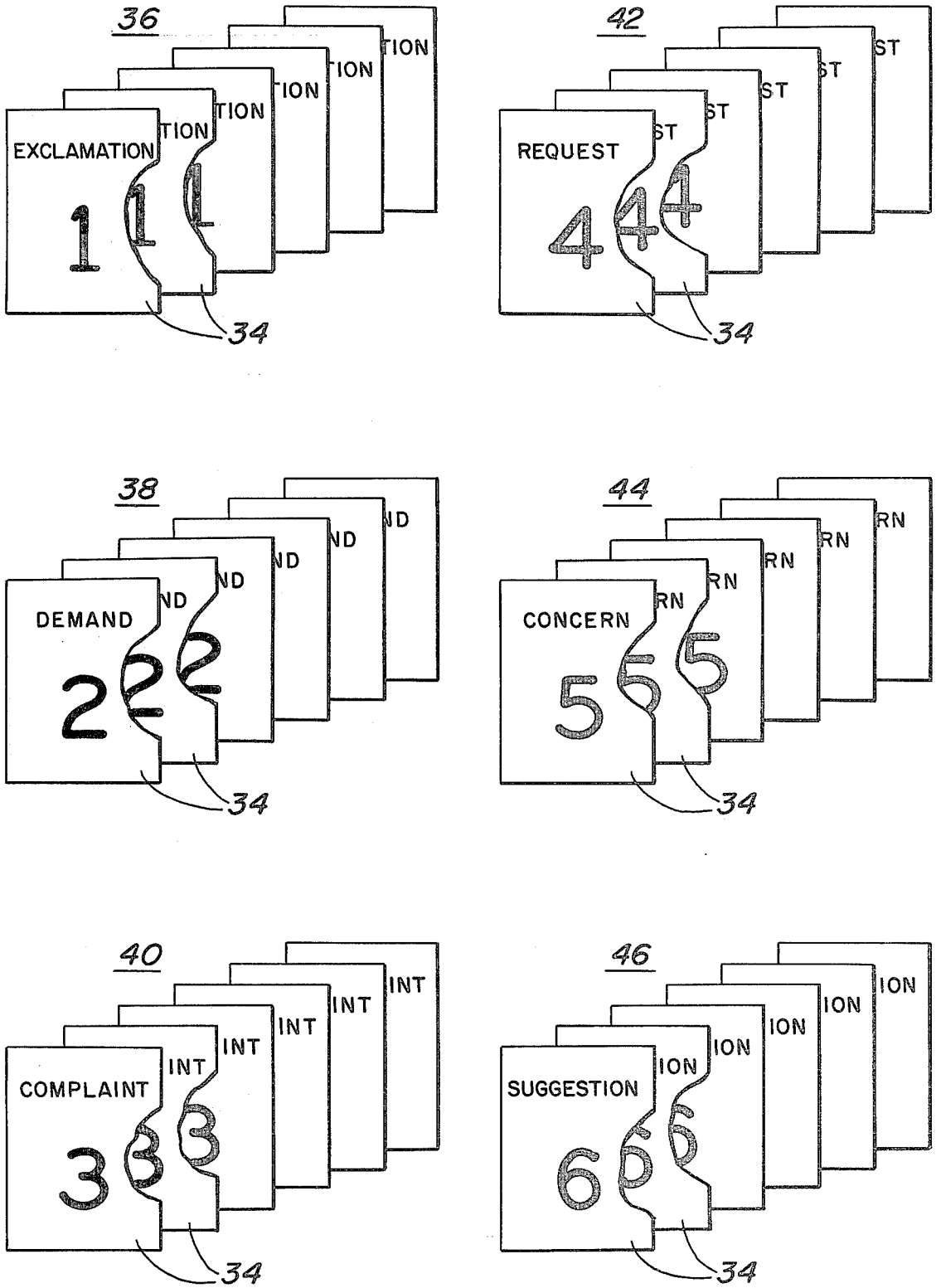
FIG. 2 is an elevational view of one embodiment of a set of cards used in the game shown in FIG. 1.

In FIG. 2 there is shown all of the thirty-six cards 34 making up the deck 22. As can be seen, the deck 22 consists of six groups of cards 36, 38, 40, 42, 44 and 46. Each group includes six cards. The six cards of the group 36 all bear the intentional word EXCLAMATION and the associated numeral 1 on the front side thereof. The numeral 1 represents the score value of the EXCLAMATION card. Similarly, each of the cards 34 of the group 38 bearing the intentional word DEMAND and the score value numeral 2, each of the cards 34 of the group 40 bear the intentional word COMPLAINT and the score value numeral 3, each of the cards 34 of the group 42 bear the intentional word REQUEST and the score value numeral 4, each of the cards 34 of the group 44 include the intentional word CONCERN and the score value numeral 5 and each of the cards 34 of the group 46 bear the intentional word SUGGESTION and the score value numeral 6. The score values 1–6 appearing on the cards of the respective groups are selected in accordance with the level of maturational functioning associated with the intentions thereof, e.g., the intention SUGGESTION being indicative of the highest level of maturational functioning.

The object of the game is to accumulate points more quickly than opponents to permit one's mover 24 to move along the board, via the path 33, to arrive at the finish space 32 before the movers of the opponents. The amount of spaces 28 moved during each hand is determined by the degree of mature functioning exhibited by the behavior of the players during the hand, which in turn determines the amount of score acquired. Behaving maturely means that each player can get other players to understand him and that he can understand other players.

THE DEAL

The deck 22 of cards 34 is shuffled and the dealer deals six cards 34 to each player, 48, 50, 52 and 54. Each player shuffles his cards well and holds the cards in his hand in the same manner as using an ordinary deck of playing cards so that all opposing players only see the rear side of his cards. The position of the cards 34 in the player's hand, once set up, cannot be changed during the course of the game except through the process of playing as prescribed by the procedures.

THE PLAY

The play of game 20 is accomplished in given hands, with hands passing alternatively from player to player in the counterclockwise direction, the first player being selected by agreement. The first player in a hand is called the communicator and starts the hand in play. In the example shown in FIG. 1 it is assumed that player 48 is the communicator. The play starts by the communicator looking at the top card in his hand. In the example shown in FIG. 1 the top card, position 49, bears the intentional word CONCERN thereon. The communicator then must communicate the intention CONCERN to the opposing players by making a verbal or non-verbal expression to match that intention. After making the expression, the communicator places the card face down on the table in front of himself. Each of the opposing players 50, 52 and 54 tries to understand the expression communicated by the communicator 48. To that end, each player selects the card from his hand which he believes best matches the expression communicated. The card selected by each player is then placed face down in front of the player. When all the cards are down they are simultaneously turned up to expose their face sides and the intentional indicia appearing thereon.

Points are acquired by the communicator whenever one of the opposing players matches the communicator's exposed card. The points acquired by the communicator are the sum of all of the score values appearing on the exposed matching cards. The communicator 28 advances his mover 24 by the amount of spaces 28 equal to the score accumulated. Each player of the opposing players 50, 52 and 54, who has matched the card of the communicator receives the score value of his matching card and advance his respective mover down the board by that value. All of the players then pick up their exposed cards and place these cards in the back of their hands, e.g., position 51.

The next hand of the game is played, with the next succeeding player, 50, becoming the communicator. Each player takes a turn each hand until there is a winner. The game may be continued to determine finishing places. To that end, all players continue to play, but players who have already reached the finish space 32 skip their turns at becoming a communicator and no longer acquire any score value when they match the communicator's card.

It should be pointed out at this juncture that while in the preferred embodiment of the game the six intentions EXCLAMATION, DEMAND, COMPLAINT, REQUEST, CONCERN and SUGGESTION appear as indicia on the cards, it is clear that synonyms can be used for the identified intentions. For example, the synonym COMMENT can be used for the intention CONCERN, the synonym COMMAND for the intention DEMAND, the synonym QUESTION for the intention REQUEST, etc. Nevertheless, the intentions specifically identified herein have been selected since they best serve to convey the fullest meaning of each intentional category.

The game 20 of the invention is of wide ranging utility and is particularly suited for social use, educational use, therapeutic use, and evaluative use since its use vividly displays the ability to communicate and to comprehend conveyed expressions.

In this connection, socially the game can be enjoyed by family and friends as well as strangers. With every hand played there is the possibility of any player gaining points, therefore, there is a total involvement through the course of the game. Advancement of the mover down the board resembles a race and this adds to the excitement and enjoyment of the game. Since there is no possibility of thwarting another player's progress without thwarting one's own progress, cooperation is fostered by the game. If players become "too cooperative" by using simplistic expressions, an element of realism can be added by specifying that the content be a phenomenon, problem, or issue of emotional interest to all players.

Accordingly, when used socially the game 20 fosters full participation, cooperation, respect for the opinions of others, sensitization to and understanding of others' communications, and, of course, fun.

The game 20 is also a valuable educational tool at the third grade level and above. Traditionally, students are taught to discriminate intentions by considering only statements, questions and exclamations. However, this discrimination is one based primarily on syntax. A more valid and useful categorization is according to the six categories postulated. The six intentions used in the game help students to discriminate simultaneously by syntax, stress, pitch and context. In addition, the student can be taught the developmental sequence of intentions as set forth heretofore and gradually learn to replace less mature ways of communicating with more mature ways. Needless to say, such activity can make classroom management much easier after generalization occurs. In time, and with mastery, generalization will spread to the home and social environments of the student and may be of benefit to others who have never come into contact with the game. The educational use of the game is seen as most important since students are constantly encouraged by social values, directly and indirectly, to behave maturely. The game 20 provides the student with a definite sequence of verbalizations which can be used to assess, with the help of his teachers, his level of maturational functioning from day to day.

The therapeutic use of the game MATURITY is also of considerable importance. Since a game is non-serious and object-oriented, it can serve as an excellent nonthreatening device in the beginning phase of treatment. MATURITY, in particular, can be played with the specified content of each sequential game being more related to the central treatment issues. While it can be used in individual treatment, it will probably be most suited for use in group and family treatment. Since group members in treatment usually do not know each other, playing the game 20 can quickly promote the establishment of a controlled therapeutic atmosphere. Both the content and intent of each member can be studied by the group and help may be given after understanding is reached. Misinterpretations can be highlighted and discussed in a constructive way.

The game 20 is also of considerable evaluative utility. In this connection, social, educational, and therapeutic changes can be evaluated by the use of the game. If specific objective records are kept, such as time of game duration, moves needed to win, finishing places of participants, etc., then change can be evaluated by comparing data over time. The data from these dependent variables can provide the evaluator with information upon which to make assessments. More subjective assessments can eventually be made by an evaluator who is especially tuned into the unconscious dynamics associated with specific results.

Without further elaboration, the foregoing will so fully illustrate my invention that others may, by applying current or future knowledge, readily adapt the same for use under various conditions of service.

What is claimed as the invention is:

1. A method of playing a game by at least two players utilizing a pack of cards in order to demonstrate the maturational level of the players, said pack including six different sets of cards, each set including plural identical cards, all of the cards of each set bearing a word connoting one manifestation of the intent variable of any communication and an associated score value indicia on the face side of the card, the rear side of all of said cards having the same appearance, said method comprising providing each player with a hand of plural randomly selected cards, one player preselecting a card, said one player making a verbal or non-verbal expression exemplifying but not synonymous with the word appearing on said preselected card, whereby each of the other players is able to associate said expression with said word through a mental determination, each of said other players selecting a card from his hand bearing the word he believes was exemplified by the verbal or non-verbal expression, assigning to said one player a score value equal to the sum of the score values of the cards selected by said other players which match the preselected card and assigning to each of said other players who select a card which matches said preselected card the score value of said card.

2. The method of claim 1 wherein said words or synonyms thereof form the totality of different manifestations of the intent value of any communication and wherein the score value associated with each word is a function of the maturational value of said word.

3. The method of claim 2 wherein said words are EXCLAMATION, DEMAND, COMPLAINT, REQUEST, CONCERN and SUGGESTION and wherein the score values for said words increase from EXCLAMATION to DEMAND to COMPLAINT to REQUEST to CONCERN to SUGGESTION to represent increasing levels of maturational functioning.

4. The method of claim 3 wherein said game additionally comprises respective movers for each player and a game board comprising plural positions to be traversed by each marked in sequential steps from a start position to a finish position, the number of steps taken during each hand being a function of the score values accumulated therein.

* * * * *